US010011124B2

(12) United States Patent
Ogasawara et al.

(10) Patent No.: US 10,011,124 B2
(45) Date of Patent: Jul. 3, 2018

(54) PERFORMING MARGINLESS PRINTING BASED ON IMAGE DATA

(71) Applicant: CANON KABUSHIKI KAISHA, Tokyo (JP)

(72) Inventors: Seiji Ogasawara, Machida (JP); Tetsuji Kurata, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 15/160,574

(22) Filed: May 20, 2016

(65) Prior Publication Data

US 2016/0347095 A1 Dec. 1, 2016

(30) Foreign Application Priority Data

May 27, 2015 (JP) ..... 2015-108004
May 27, 2015 (JP) ..... 2015-108006

(51) Int. Cl.
*B41J 11/00* (2006.01)

(52) U.S. Cl.
CPC ..... *B41J 11/0085* (2013.01); *B41J 11/008* (2013.01); *B41J 11/0065* (2013.01); *B41J 11/0095* (2013.01)

(58) Field of Classification Search
CPC .. B41J 13/009; B41J 11/0085; B41J 11/0065; B41J 11/0095; B41J 11/008; B41J 2/16508
See application file for complete search history.

(56) References Cited

U.S. PATENT DOCUMENTS

| | | | | |
|---|---|---|---|---|
| 5,398,049 | A | 3/1995 | Terasawa et al. | |
| 5,880,754 | A | 3/1999 | Niikura et al. | |
| 6,471,315 | B1 | 10/2002 | Kurata | |
| 6,886,909 | B2 | 5/2005 | Ogasawara | |
| 6,899,411 | B2 | 5/2005 | Niikura et al. | |
| 7,284,814 | B2 | 10/2007 | Ogasawara | |
| 8,950,844 | B2 | 2/2015 | Takahashi et al. | |
| 9,090,099 | B2 | 7/2015 | Ogasawara | |
| 2006/0033795 | A1 * | 2/2006 | Yokoi | B41J 11/008 347/104 |

FOREIGN PATENT DOCUMENTS

JP 2006-021475 1/2006

OTHER PUBLICATIONS

U.S. Appl. No. 15/160,382, filed May 20, 2016.
U.S. Appl. No. 15/160,532, filed May 20, 2016.
U.S. Appl. No. 15/160,756, filed May 20, 2016.

* cited by examiner

*Primary Examiner* — Juanita D Jackson
(74) *Attorney, Agent, or Firm* — Fitzpatrick, Cella, Harper & Scinto

(57) ABSTRACT

Marginless printing is performed by using a printhead which ejects ink. Information on an inclination of a sheet to be conveyed is obtained, and in performing the marginless printing at a leading end of the sheet, an image region with respect to which ink is discarded to an outside of the sheet is set based on the obtained information. Further, a platen which supports the sheet by sucking in a manner facing the printhead which ejects the ink is provided and control is performed such that in performing printing sequentially from the leading end to a trailing end of the sheet, suction force of the platen is decreased upon approach of a portion to be printed to the trailing end of the sheet.

20 Claims, 16 Drawing Sheets

PERFORMING MARGINLESS PRINTING BASED ON IMAGE DATA

BACKGROUND OF THE INVENTION

Field of the Invention

The present invention relates to a technique of inkjet printing which can perform marginless printing.

Description of the Related Art

In marginless printing performed by an inkjet printing apparatus, a printing operation is performed based on image data corresponding to a region which is larger in size than a sheet such that a border does not remain on the sheet even though errors in sheet conveyance or the like occur. Japanese Patent Laid-Open No. 2006-021475 discloses a printing apparatus which can perform marginless printing.

In sheet conveyance, a phenomenon called skewing occasionally occurs, in which a sheet is conveyed with an inclination relative to an advance direction. In Japanese Patent Laid-Open No. 2006-021475, since the influence of the occurrence of skewing in performing marginless printing is not taken into consideration, if skewing occurs, the quantity of ink discarded to the outside of the sheet increases, and as a result, unnecessary ink consumption increases in some cases. Further, in Japanese Patent Laid-Open No. 2006-021475, a sheet is sucked by a suction platen. In this configuration, in performing marginless printing at a trailing end of the sheet, atomized ink mist is occasionally sucked into a gap between the sheet and a suction unit, resulting in adhesion of the ink mist to the reverse of the sheet particularly at the trailing end thereof to smear the sheet.

SUMMARY OF THE INVENTION

An object of the present invention is to suppress an increase in unnecessary ink consumption even though skewing occurs on a sheet in performing marginless printing. Another object of the present invention is to reduce the quantity of ink mist which adheres to the reverse of the sheet in a printing apparatus having a suction platen.

One aspect of the present invention is a printing method for performing marginless printing by using a printhead which ejects ink, the method including the steps of: obtaining information on an inclination of a sheet to be conveyed; and setting, in performing the marginless printing at a leading end of the sheet, based on the obtained information, an image region with respect to which the ink is discarded to the outside of the sheet.

Further features of the present invention will become apparent from the following description of exemplary embodiments (with reference to the attached drawings).

DESCRIPTION OF THE EMBODIMENTS

With reference to the drawings, an embodiment according to the present invention will be described in detail.

Figure 1:
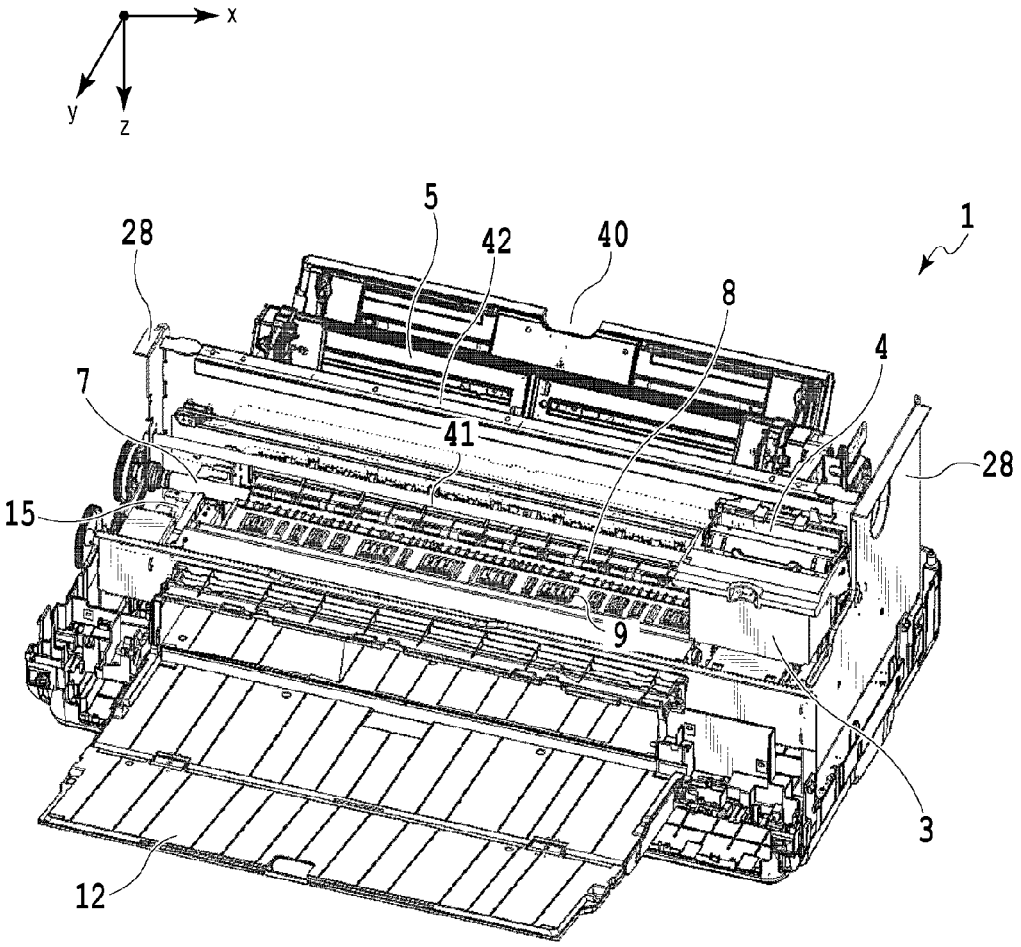
FIG. 1 is a schematic perspective view showing the configuration of a printing apparatus.
Figure 2:
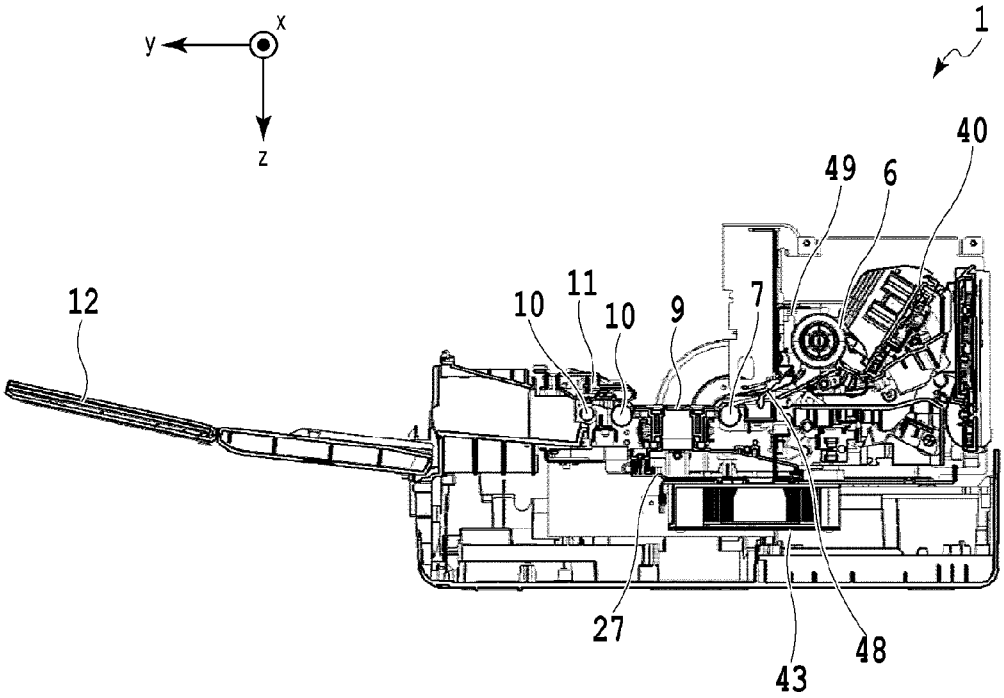
FIG. 2 is a schematic cross-sectional view showing the configuration of the printing apparatus.

FIG. 1 is a schematic perspective view showing the configuration of a printing apparatus 1. FIG. 2 is a schematic cross-sectional view showing the configuration of the printing apparatus 1. The printing apparatus 1 is an inkjet printer which ejects ink from an ejection port, and is a printer of a serial type which can perform marginless printing in which ink is ejected to a sheet up to its border. Here, an explanation will be given of an apparatus having a printing function only, but the present invention is applicable to an apparatus having a copying function, a facsimile function, and the like.

The printing apparatus 1 has a feeder 40 and prints an image or the like on a sheet fed from the feeder 40. The feeder 40 has a feed tray 5 and a feed roller 6. The feed roller 6 contacts the sheet stacked on the feed tray 5 and rotates to unroll the sheet one by one from the feeder 40 and the sheet is fed to the printing apparatus 1. The printing apparatus 1 includes also a printhead 3, a carriage 4, a conveyance roller 7, a pinch roller 8, a platen 9, discharge rollers 10, a pulley 11, a discharge tray 12, and a tube pump 15.

The sheet fed from the feeder 40 is held by a conveyance roller pair of the conveyance roller 7 and the pinch roller 8 and is conveyed, by their rotation, downstream in a sheet conveyance direction (a y direction shown in the drawings) to move to a space between the printhead 3 and the platen 9. On an ejection port forming surface facing in a gravity direction (a z direction shown in the drawings) of the printhead 3, a plurality of ejection ports are formed. The printhead 3 is mounted on the carriage 4. The carriage 4 is supported by a carriage guide shaft 41 and a carriage rail 42 which extend in a direction (an x direction shown in the drawings) transverse to the conveyance direction, and is capable of making a reciprocating motion in the x direction. The platen 9 is disposed at a position facing the ejection port forming surface of the printhead 3 and supports the sheet from the reverse of the sheet facing the ejection port forming surface. A duct 27 and a negative pressure generation mechanism 43 are disposed in the z direction downward of the position of the platen 9. The x direction is a widthwise direction of the sheet to be conveyed as well as a moving direction of the carriage 4 and the y direction is the sheet conveyance direction.

The sheet conveyed, by the conveyance roller pair, downstream in the y direction is held by a discharge roller pair of the discharge roller 10 and the pulley 11 and is discharged, by their rotation, toward the discharge tray 12 from the inside of the printing apparatus 1. An intermittent feeding operation (sub scanning) of the sheet performed by the roller pairs and an ejecting operation of ejecting ink from the ejection port of the printhead 3 together with a scanning movement (main-scanning) of the carriage 4 are repeated to perform serial printing an image in a serial printing system.

The feeder 40, carriage guide shaft 41, carriage rail 42, platen 9, and the like are fixed to a chassis 28.

As shown in FIG. 2, an end detection lever 48 and a lever detection sensor 49 are disposed between the feed roller 6 and the conveyance roller pair. The end detection lever 48 is disposed at a position where the end detection lever 48 contacts the sheet conveyed from the feed roller 6 to the conveyance roller pair and is configured such that its postures are different in states in which the end detection lever 48 contacts and does not contact the sheet. The lever detection sensor 49 is a reflective light sensor and constitutes a detection unit for detecting that the leading end or the trailing end of the sheet to be conveyed reaches a detection position, based on a change in the posture of the end detection lever 48 caused by the passage of the sheet.

Figure 3:
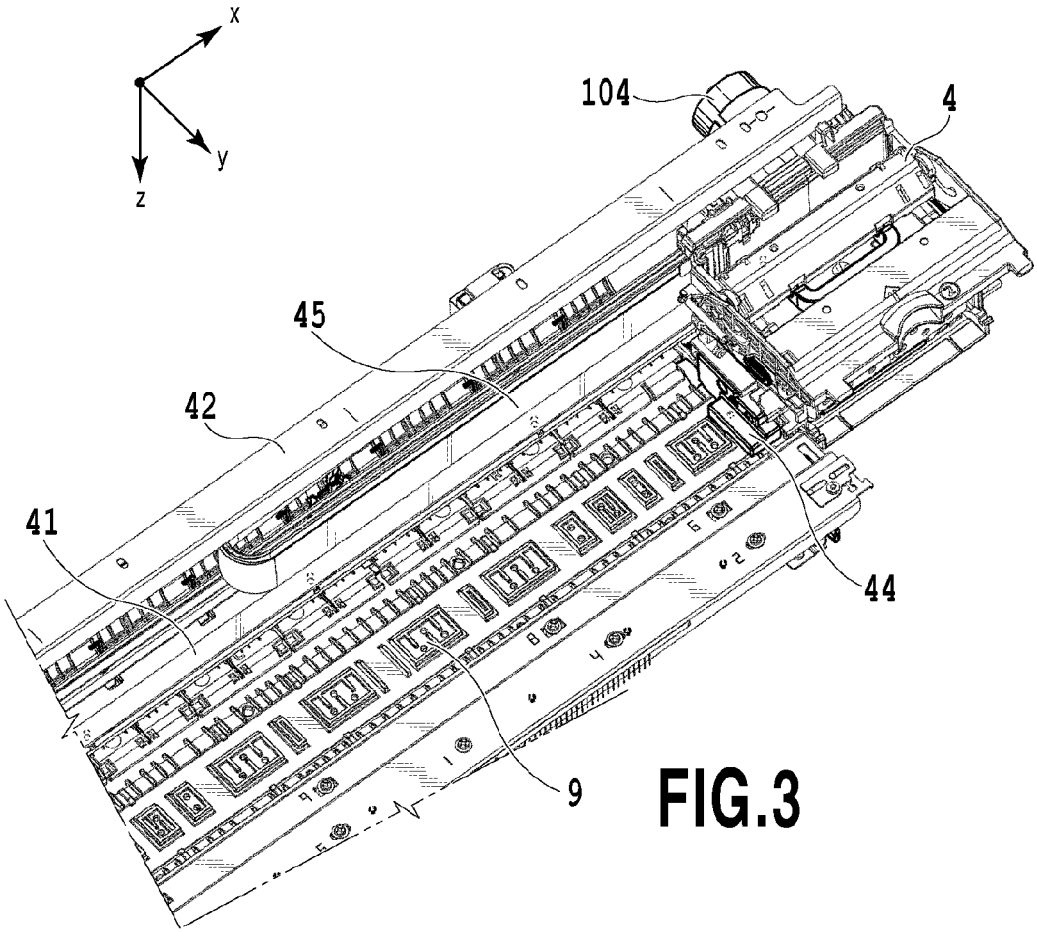
FIG. 3 is a perspective view showing the peripheral structure of a carriage.

FIG. 3 is a perspective view showing the peripheral structure of the carriage 4. It should be noted that the view shows a state in which the printhead 3 is removed. On one of side surfaces in the x direction of the carriage 4, a carriage sensor 44 (a sheet end detection sensor) is mounted. The carriage sensor 44 is a sensor constituting a detection unit for detecting an end of a sheet 2. The carriage sensor 44 is a reflective light sensor having a light emitting unit and a light receiving unit, in which the light emitting unit emits light in the z direction, light reflected from the platen 9 or the sheet 2 is received at the light receiving unit, and the received light is converted into an electric signal to be output.

The carriage sensor 44 is disposed further downstream in the y direction of a most downstream ejection port in the y direction. The printhead 3 and the carriage sensor 44 are in a positional relation in which in single pass printing, results of detection of a side end obtained from the carriage sensor 44 in one movement of the carriage 4 can be reflected to the ejecting operation of the printhead 3 along with the next movement of the carriage 4. The detection of a left and a right end will be described later with reference to FIG. 14.

Here, an explanation will be given of printing an image in a serial printing system by the single pass printing. Printing of an image is not limited to this, but may be performed by multiple pass printing in which an image is completed in a predetermined region by an ink ejecting operation of the printhead 3 along with the movement of the carriage 4 multiple times. In this case, the timing of reflecting the results of detection of the left and the right ends obtained by the carriage sensor 44 are adjusted as appropriate.

The carriage 4 is driven by a carriage drive motor 104. The carriage 4 has a flexible cable 45 connected thereto. A drive signal to the printhead mounted on the carriage 4 is transmitted from a CPU 101, which will be described later with reference to FIG. 11, through the flexible cable 45 to the printhead 3. Further, a detection signal from the carriage sensor 44 is input via the flexible cable 45 to the CPU 101.

Figure 4:
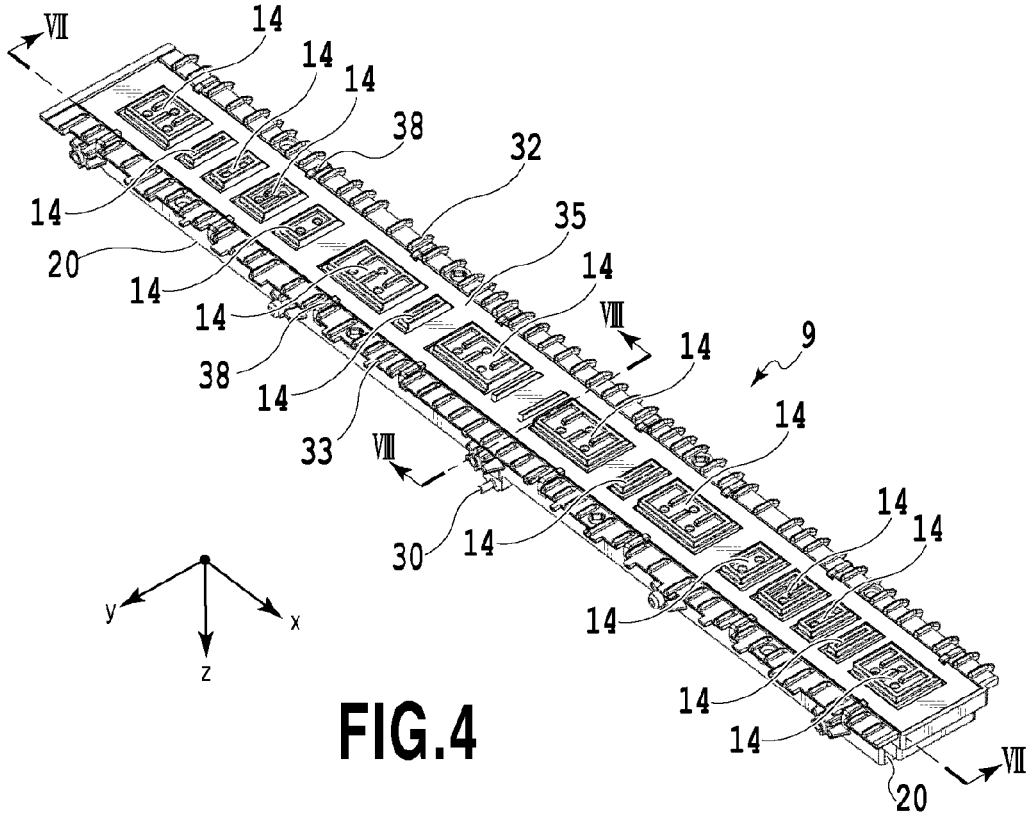
FIG. 4 is a perspective view showing a platen.
Figure 5:
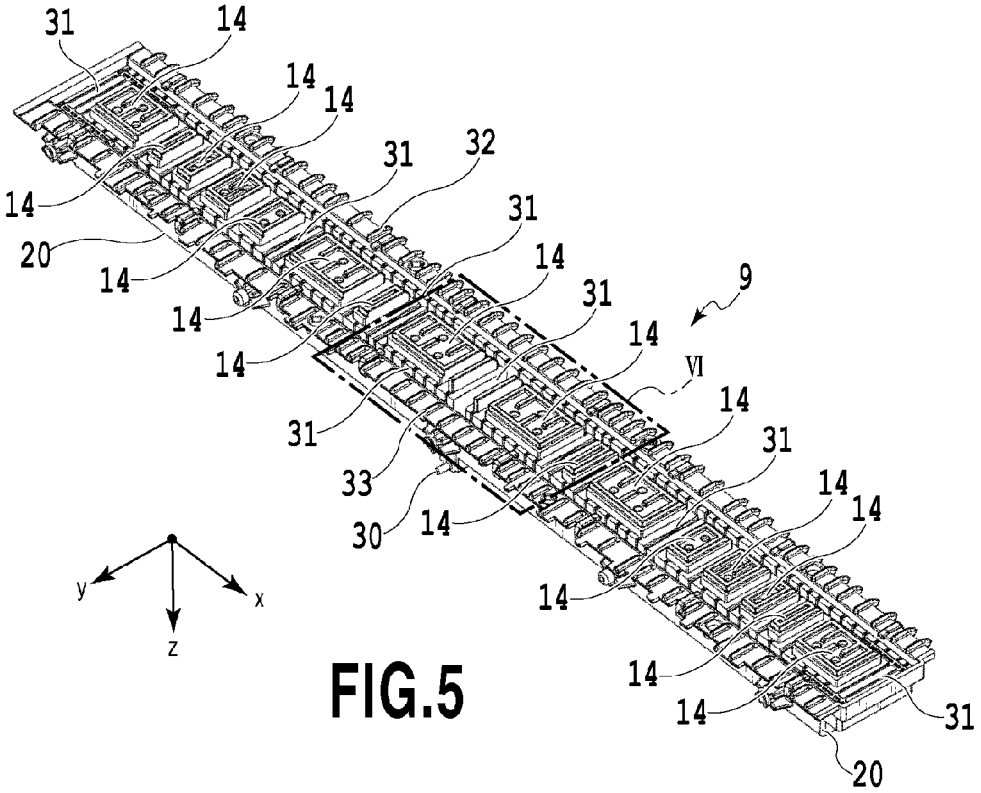
FIG. 5 is a perspective view showing the platen.
Figure 6:
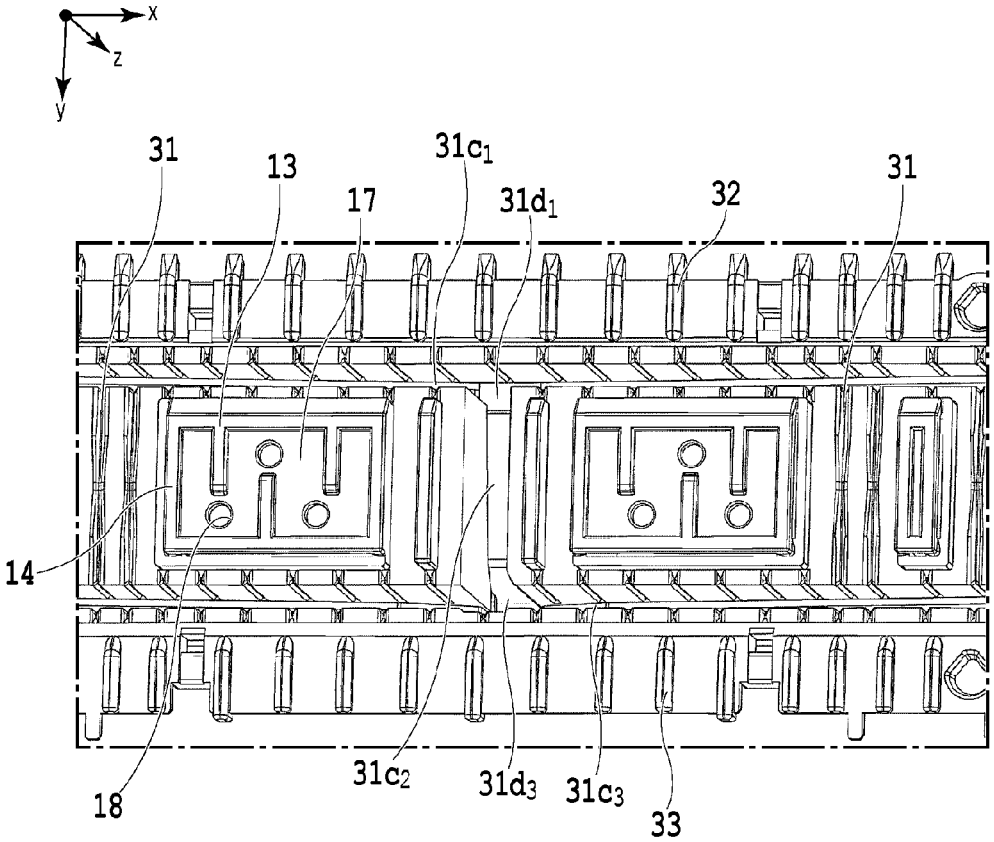
FIG. 6 is an enlarged perspective view of the platen.
Figure 7:
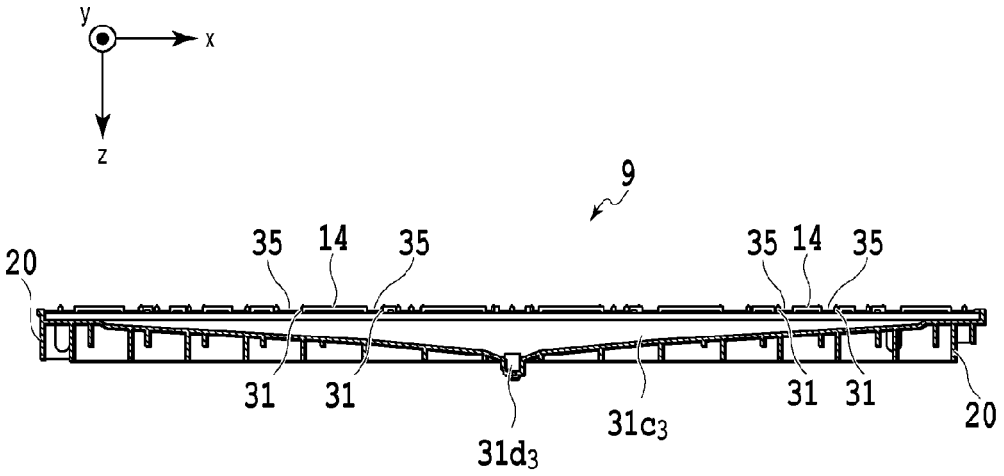
FIG. 7 is a cross-sectional view showing the platen.
Figure 8:
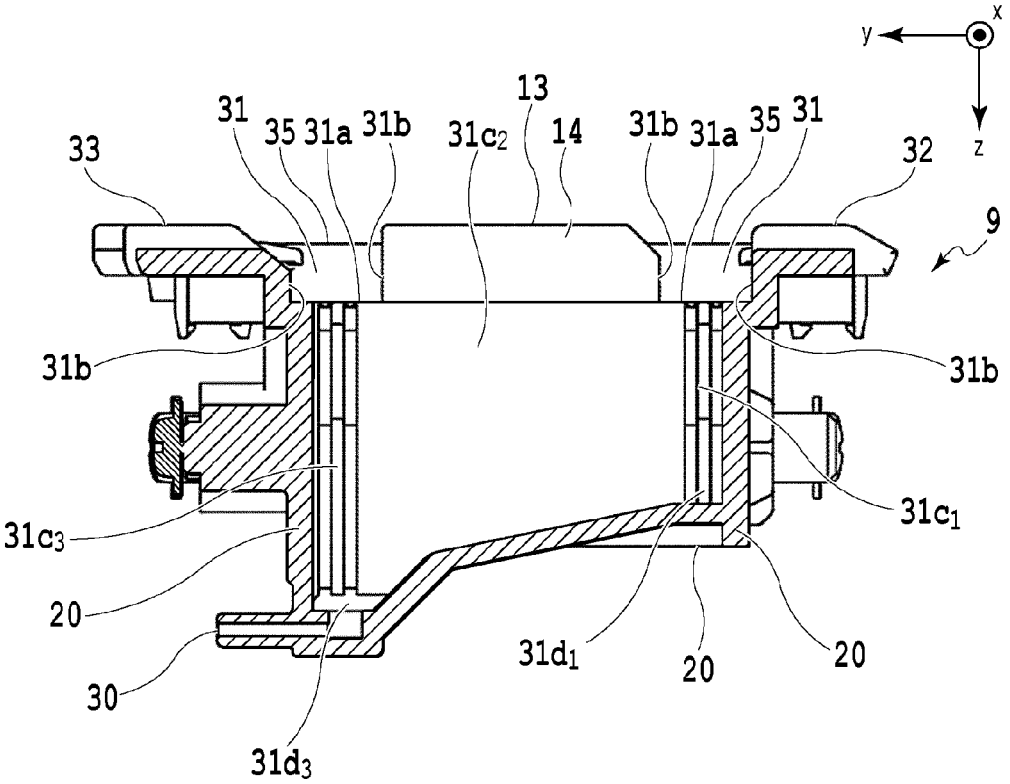
FIG. 8 is a cross-sectional view showing the platen.

With reference to FIG. 4 to FIG. 8, the platen 9 will be described. FIG. 4 is a perspective view showing the platen 9. FIG. 5 is a perspective view showing the platen 9 before an absorbing member 35 shown in FIG. 4 is disposed thereon. FIG. 6 is an enlarged perspective view of a portion VI enclosed with a dotted line shown in FIG. 5. FIG. 7 is a cross-sectional view taken along a dotted line VII-VII shown in FIG. 4. FIG. 8 is a cross-sectional view taken along a dotted VIII-VIII shown in FIG. 4.

As shown in FIG. 4 to FIG. 6, the platen 9 is provided with an upstream supporting portion 32 and a downstream supporting portion 33 at portions upstream and downstream in the y direction thereof, respectively. At a position between the upstream supporting portion 32 and the downstream supporting portion 33, supporting portions 14 are provided. These supporting portions support the sheet from the reverse of the sheet. The upstream supporting portion 32 guides the sheet conveyed by the conveyance roller pair to the supporting portion 14. The downstream supporting portion 33 guides the sheet conveyed by the conveyance roller pair to the discharge roller pair. As shown in FIG. 6, the supporting portion 14 has a supporting surface 13 and a recess 17. The upstream supporting portion 32 and the downstream supporting portion 33 are ribs provided such that they contact the sheet at the same height (position in the z direction) as that of the supporting surface 13 and the plurality of upstream supporting portions 32 and the plurality of downstream supporting portions 33 are provided. The supporting portion 14 is in a rectangular shape and its outer periphery forms the supporting surface 13 having a predetermined width and the inside portion of the supporting portion 14 forms the recess 17 which is more deeply recessed than the supporting surface 13. Further, as shown in FIG. 4 to FIG. 6 and FIG. 8, an end in the y direction upstream of the supporting portion 14 is inclined upward in the z direction from the upstream side toward the downstream side in the y direction and the sheet can be smoothly conveyed downstream in the y direction along the inclination. As shown in FIG. 4 and FIG. 5, the supporting portions 14 in a plurality of types in different sizes are disposed. Most of the recesses 17 of the supporting portions 14 are provided with suction holes 18. Further, the recess 17 in a relatively large size of the supporting portion 14 is provided with a rib extending in the y direction and being positioned at the same height as that of the supporting surface 13 for preventing the sheet from denting at the recess 17, and the rib also supports the sheet as the supporting surface 13.

As shown in FIG. 5 to FIG. 8, in the surroundings of the supporting portion 14, ink discarding grooves 31 (ink receivers) are provided adjacent to the supporting portion. As shown in FIG. 8, each of the grooves 31 is defined by a bottom 31*a* which is at a lower position than the supporting surface 13 and side walls 31*b* and is formed in a shape capable of temporarily storing ink therein. The groove 31 receives ink ejected to the outside of the sheet in performing the marginless printing or ejected by preliminary ejection. The size and arrangement of the supporting portion 14 and the arrangement of the grooves 31 are determined such that the grooves 31 are arranged at ends of the sheet in any size to be actually used among sheets in various sizes assumed to be used.

As shown in FIGS. 4, 7, and 8, the absorbing member 35 is disposed so as to cover the grooves 31. Ink which is not applied to the sheet is received, through the absorbing member 35, at the groove 31 which is positioned in the z direction downward of the absorbing member 35. In order to prevent the ink applied to the absorbing member 35 from splashing and adhering to the reverse of the sheet or the like, it is preferable to use, as the absorbing member 35, a member capable of suppressing the splash upon the adhesion of ink. Here, a member made of expanded urethane is used as the absorbing member 35. The absorbing member 35 is supported by the side walls 31*b* and the bottom 31*a* of the groove 31. Further, the absorbing member 35 is locked by lock claws 38 shown in FIG. 4. As shown in FIG. 4, the lock claws 38 are provided at portions in the y direction upstream and downstream of the platen 9. The ink which has permeated the absorbing member 35 and been received at the groove 31 flows into a channel 31*c* which is a portion of the groove 31. The channel 31*c* includes an upstream channel 31$c_1$ provided upstream in the y direction and extending in the x direction, a downstream channel 31$c_3$ provided downstream in the y direction and extending in the x direction, and a center channel 31$c_2$ provided at a center portion in the x direction and extending in the y direction. The channels 31$c_1$ and 31*c*3 are provided so as to communication with the groove 31 extending in the y direction and have a relatively large area. The center channel 31$c_2$ is connected to the upstream channel 31$c_1$ and the downstream channel 31$c_3$ and allows the upstream channel 31$c_1$ and the downstream channel 31$c_3$ to communicate with each other.

As shown in FIG. 7, a bottom surface of the downstream channel 31$c_3$ is inclined downward in the z direction from both ends in the x direction to the center portion and a downstream accumulation portion 31$d_3$ is provided at the most downward portion of the bottom surface of the downstream channel 31$c_3$. The upstream channel 31$c_1$ is in a form similar to the downstream channel 31$c_3$ and an upstream accumulation portion 31$d_1$ is provided at its most downward portion. As shown in FIG. 8, the downstream accumulation portion 31$d_3$ is positioned in the z direction downward of the upstream accumulation portion 31$d_1$. The center channel 31$c_2$ allows the upstream channel 31$c_1$ and the downstream channel 31$c_3$ to communicate with each other so as to flow the ink accumulated in the upstream accumulation portion 31$d_1$ toward the downstream accumulation portion 31$d_3$. With this configuration, the ink received at the groove 31 through the absorbing member 35 passes through the channel to be accumulated in the downstream accumulation portion 31$d_3$. The bottom surface of the channel is inclined so as to flow the ink along the inclination. In a case of accelerating the ink flow, grooves or the like may be provided along the inclination of the inclined bottom surface.

As shown in FIGS. 5, 7, and 8, the platen 9 is provided with an outer peripheral wall 20 at its outer periphery. The outer peripheral wall 20 is provided with a discharge port 30. As shown in FIG. 8, the discharge port 30 communicates with the downstream accumulation portion 31$d_3$. The ink received at the groove 31 through the absorbing member 35 passes through the channels to be accumulated in the downstream accumulation portion 31$d_3$ and is discharged through the discharge port 30 to the outside of the platen 9.

Figure 9:
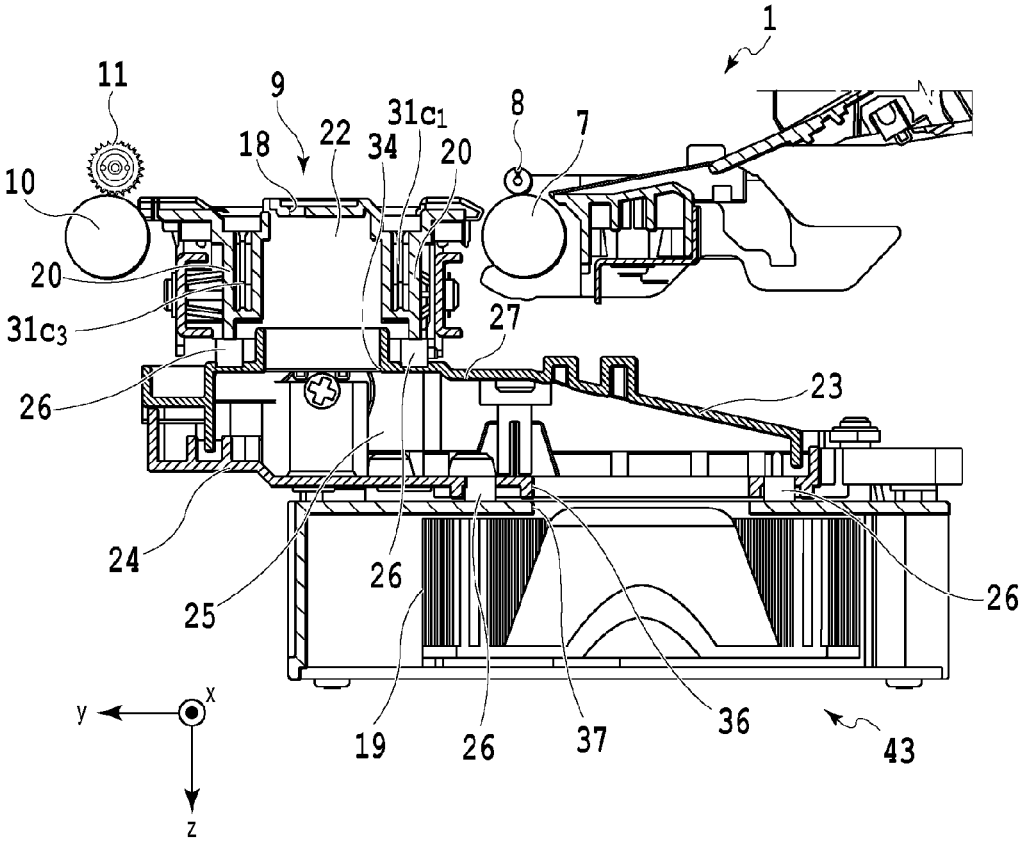
FIG. 9 is a cross-sectional view showing the peripheral structure of a duct.

FIG. 9 is a cross-sectional view showing the peripheral structure of the duct 27 and an enlarged cross-sectional view showing a portion of the cross section shown in FIG. 2. As shown in FIG. 2 and FIG. 9, the duct 27 is disposed between the platen 9 and the negative pressure generation mechanism 43. The duct 27 is formed by a cover member 23 and a base member 24. The cover member 23 and the base member 24 are provided with a first opening 34 and a second opening 36, respectively. The base member 24 is disposed on the negative pressure generation mechanism 43 so as to allow the second opening 36 and a suction port 37 of the negative pressure generation mechanism 43 to communicate with each other and the cover member 23 is disposed on the base member 24, thereby forming the duct 27 by the base member 24 and the cover member 23 to forma second negative pressure chamber 25 inside the duct 27. With the engagement of the first opening 34 on the upper surface of the cover member 23 with the bottom surface of the outer peripheral wall 20 of the platen 9, a first negative pressure chamber 22 is formed in the inner space which is in communication with the suction holes 18 of the platen 9. It should be noted that the base member 24 is fixed to the chassis 28 shown in FIG. 1

The engagement portion of the first opening 34 of the cover member 23 with the bottom surface of the outer peripheral wall 20 and an engagement portion of the second opening 36 of the base member 24 with the suction port 37 of the negative pressure generation mechanism 43 each have a seal member 26 thereon to prevent leakage of air. It is preferable that the seal member 26 should be formed of a soft member that has high sealability such that other members such as the platen 9 are not deformed by the repulsive force at the time of compression. Here, an expanded rubber member made of ethylene propylene diene rubber (EPDM) is used as the seal member 26.

As explained with reference to FIG. 5 and the like, the discharge port 30 is provided on the outer peripheral wall 20 on the side surface in the y direction downstream of the platen 9. Therefore, the duct 27 can be provided in a relatively wide space in the z direction downward of the platen 9 and the space in the second negative pressure chamber 25 in the duct 27 can be relatively wide, thereby enabling stabilization, in the second negative pressure chamber 25, of the negative pressure generated by the negative pressure generation mechanism 43.

Further, as shown in FIG. 9, the negative pressure generation mechanism 43 has a suction fan 19. The negative pressure generation mechanism 43 rotates the suction fan 19 to suck air from a gap between the reverse of the sheet on the platen 9 and the recess 17 or the like and bring the sheet into tight contact with the supporting surface 13 of the supporting portion 14 to support the sheet. Here, a sirocco fan is used for the suction fan 19. Suction force of the suction fan 19 can be changed and by control of the CPU 101, which will be described later with reference to FIG. 11, the suction force of the suction fan 19 is adjusted according to the type of sheet, the state of a sheet, environmental conditions, and the like.

Figure 10:
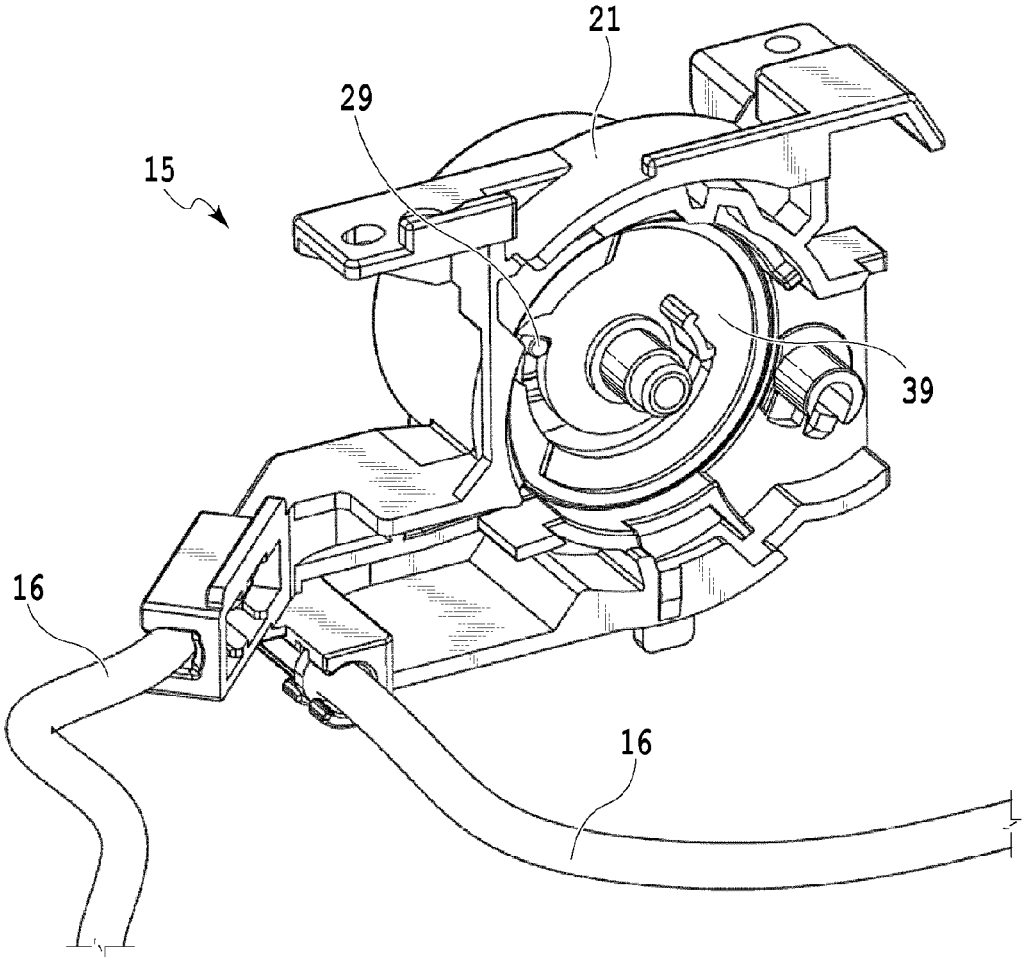
FIG. 10 is a perspective view showing the configuration of a tube pump.

FIG. 10 is a perspective view showing the tube pump 15. As shown in FIG. 10, the tube pump 15 includes a tube 16, a pump case 21, a roller 29, and a roller holder 39. The discharge port 30 of the platen 9 is connected to a suction port at an end of the tube 16 and a waste ink tank (not shown) is connected to a discharge port at the other end of the tube 16. The roller 29 is rotatably mounted on the roller holder 39. The roller holder 39 rotates by a drive force transmitted from a pump drive motor 107, which will be described later with reference to FIG. 11, via a gear train (not shown). The tube pump 15 is driven by the pump drive motor 107, which squeezes the tube 16 while being pressed against an inner diameter surface of the pump case 21 by the roller 29, thereby generating a negative pressure inside the tube 16 to suck the ink to discharge the ink through the discharge port 30. Then, the ink accumulated in the accumulation portion 31$d_3$ is discharged, through the discharge port 30 and the tube pump 15, to the waste ink tank.

The timing of the tube pump 15 to be driven, that is, the timing of ink discharge by the tube pump 15 is set, for example, in a case where the quantity of the ink discharged to the absorbing member 35 exceeds a predetermined threshold. In this case, backflow of the ink to the absorbing member 35 or the like, which occurs in a case where the quantity of the ink accumulated in the accumulation portion 31$d_3$ exceeds the accumulation capacity of the accumulation portion 31$d_3$, and adhesion of dried ink to the accumulation portion or the channels can be prevented. Further, the timing of ink discharge may be set such that ink is discharged at power-off of the printing apparatus 1, after a predetermined time has elapsed since the previous discharge, upon receipt of an instruction from a user, or the like.

Figure 11:
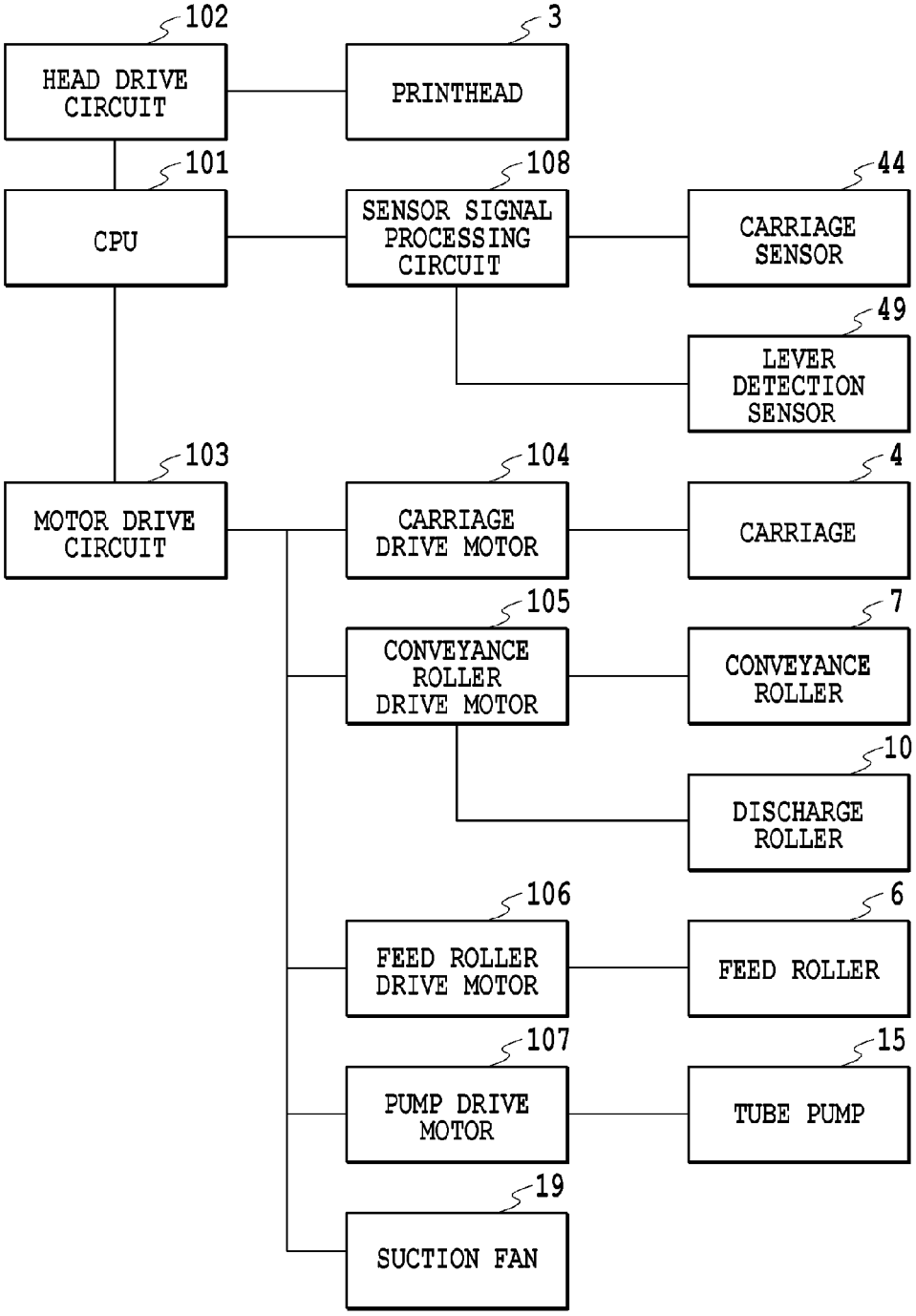
FIG. 11 is a block diagram showing the configuration of a control system of the printing apparatus.

FIG. 11 is a block diagram showing the configuration of a control system of the printing apparatus 1. A head drive circuit 102, a motor drive circuit 103, and a sensor signal processing circuit 108 are connected to the CPU 101 (an obtaining unit, a control unit). The CPU 101 controls the overall operation of the printing apparatus 1. It should be noted that the operation of the printing apparatus 1 may be controlled by an external control device which is not installed in the printing apparatus 1. The head drive circuit 102 is a circuit to drive a printing element which is an ejection energy generation element (such as a heater and a piezoelectric element) of the printhead 3. The CPU 101 controls, via the head drive circuit 102, the ink ejecting operation of the printhead 3. The motor drive circuit 103 is a circuit to drive the carriage drive motor 104, a conveyance roller drive motor 105, a feed roller drive motor 106, the pump drive motor 107, and the suction fan 19. The CPU 101 is a control unit installed in the printing apparatus and is connected, via an interface, to a host computer (an external control unit) connected to the printing apparatus.

The sensor signal processing circuit 108 is connected to the carriage sensor 44 and the lever detection sensor 49. The CPU 101 controls, via the sensor signal processing circuit 108, turning on and off of the power to the carriage sensor 44 and the lever detection sensor 49. Signals from the carriage sensor 44 and the lever detection sensor 49 are input to the sensor signal processing circuit 108 to be processed. The processed information is output from the sensor signal processing circuit 108 to the CPU 101. The CPU 101 obtains, based on the information output from the sensor signal processing circuit 108, the position and skewing (an inclination relative to an advance direction) of the sheet 2 and according to the position and skewing, the CPU 101 controls processing with respect to the leading end of the sheet in the printing operation. The description will be given in detail later with reference to FIG. 12 or the like. It should be noted that the leading end refers to an end positioned in the y direction downstream of the sheet, a left and a right end each refers to each of both ends in the x direction of the sheet, and the trailing end refers to an end positioned in the y direction upstream of the sheet.

Figure 12:
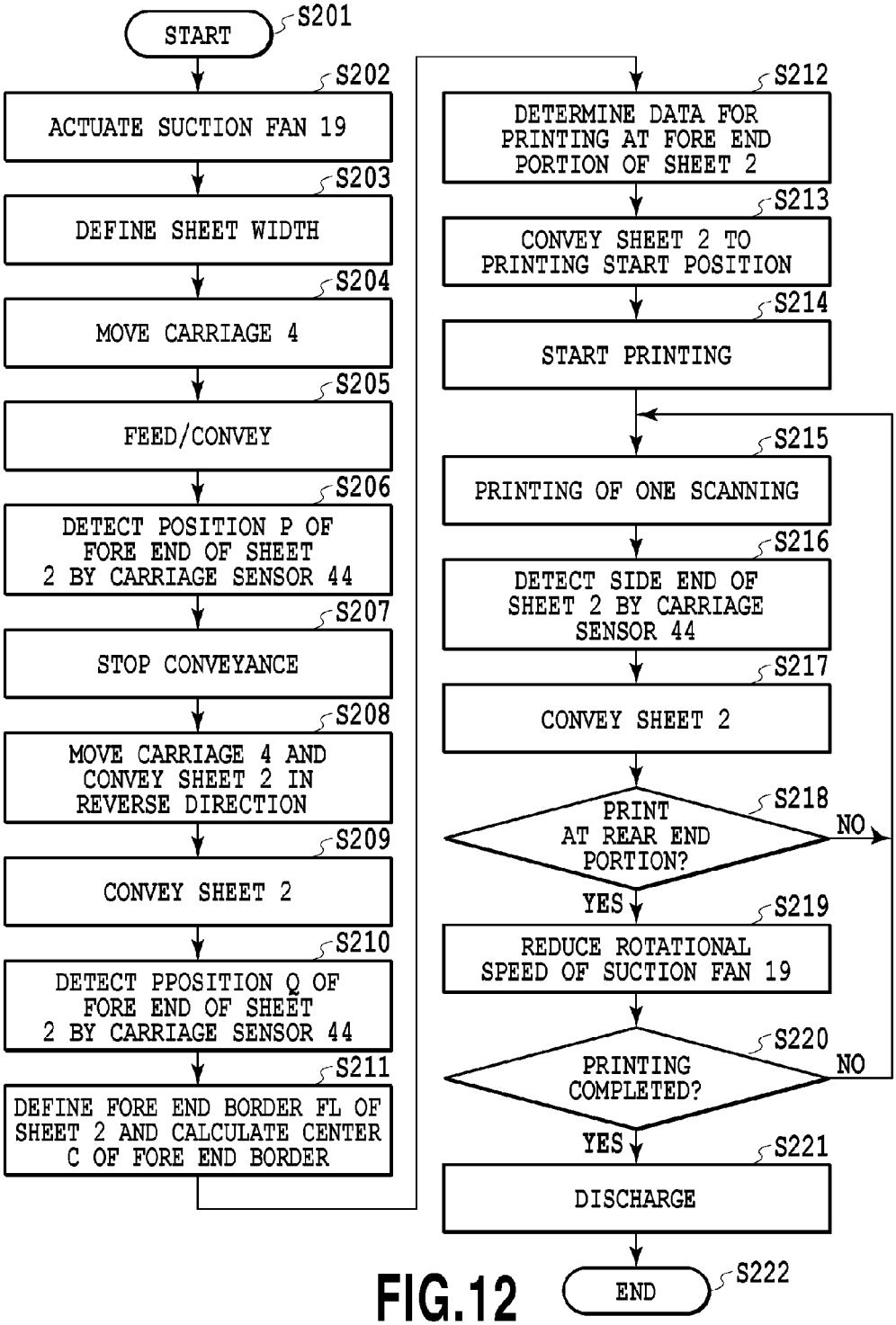
FIG. 12 is a flowchart for explaining a flow of a marginless printing operation.
Figure 13A:
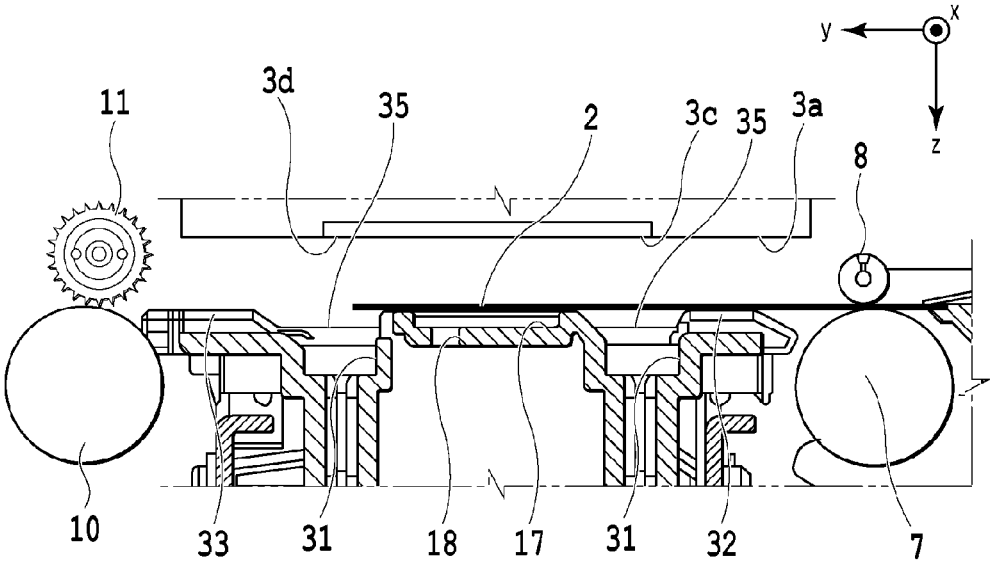
FIGS. 13A and 13B are cross-sectional views for explaining positions of a sheet.
Figure 13B:
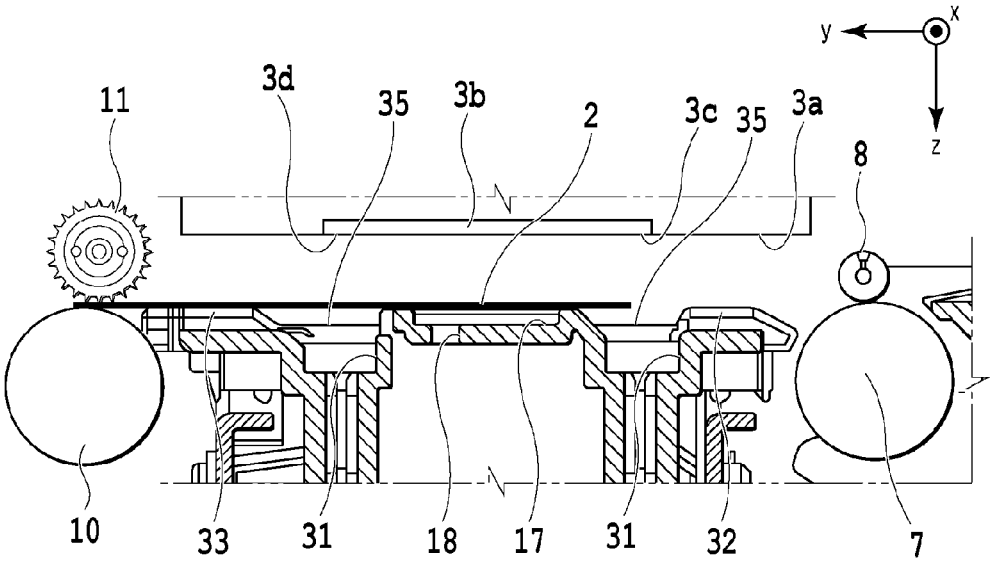
Figure 14:
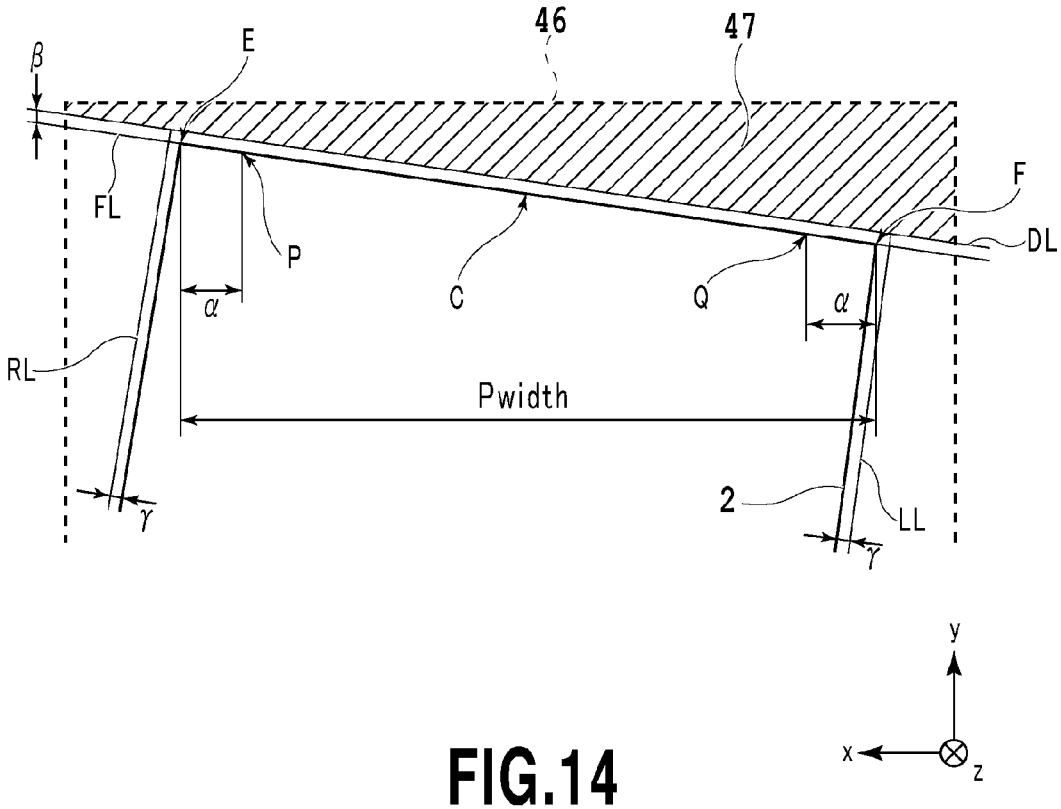
FIG. 14 is a schematic view for explaining processing with respect to a leading end and a side end of a sheet.
Figure 15:
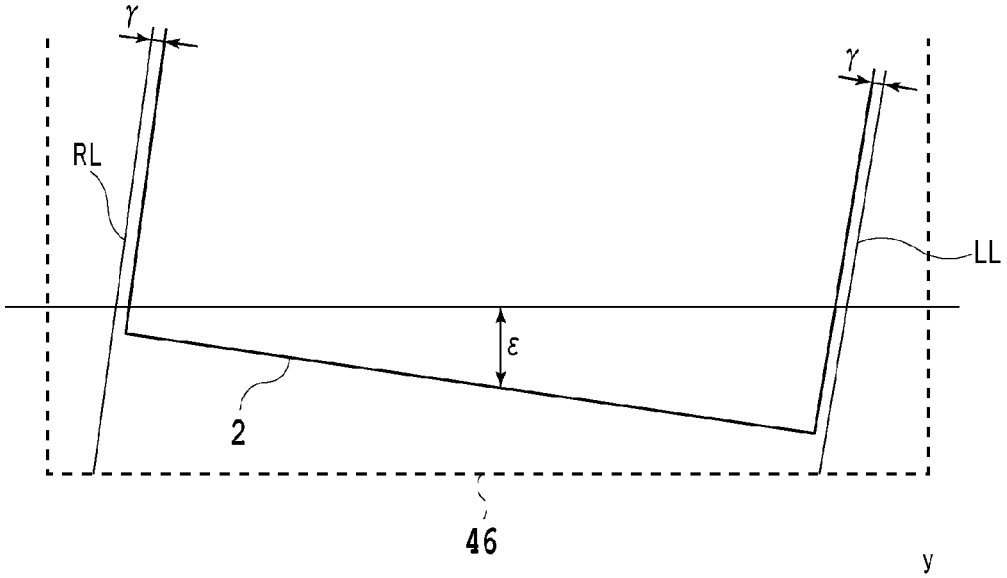
FIG. 15 is a schematic view for explaining processing with respect to a trailing end of a sheet.
Figure 15:
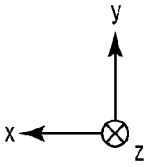

With reference to FIG. 12 to FIG. 15, a description will be given of processing with respect to the leading end, left and right side ends, and trailing end of the sheet in the marginless printing operation. FIG. 12 is a flowchart for explaining a flow of the marginless printing operation, FIGS. 13A and 13B are views for explaining the position of the sheet in each of operations, FIG. 14 is a schematic view for explaining processing with respect to the leading end and left side and right side ends of the sheet, and FIG. 15 is a schematic view for explaining processing with respect to the trailing end of the sheet.

A description will be given of processing performed after a marginless printing start instruction is input to the CPU 101. In the printing apparatus according to the present embodiment, marginless printing and border printing can be selectively performed and it is determined, in advance, whether marginless printing processing is performed. In a case of performing the marginless printing, a sequence shown in FIG. 12 is performed. It should be noted that the sequence control is performed by the CPU 101 installed in the printing apparatus, but the same sequence control may be performed by a host computer connected to the printing apparatus.

As shown in FIG. 12, upon the input of the marginless printing start instruction from a user to the CPU 101, the CPU 101 starts the marginless printing processing (S201). The printing start instruction includes information on the type (the size as well) of sheet, but the information on the type of sheet may be detected by the detection unit such as a sensor to be input to the CPU 101. Upon receipt of the marginless printing instruction, the CPU 101 generates image data (data for driving the head) for the marginless printing corresponding to a region which is larger in size than the sheet such that a border does not remain on the sheet even though errors or the like in sheet conveyance occur.

The CPU 101 actuates, via the motor drive circuit 103, the suction fan 19 to prepare to suck the sheet 2 to the platen 9 for supporting the sheet 2 (S202). The CPU 101 defines the width (the length in the x direction) of the sheet based on the information on the type of sheet (S203) and moves the carriage 4 to a position inward of an end portion of the sheet 2 by a predetermined amount. To be specific, the CPU 101 moves the carriage 4 such that the carriage 4 is positioned inward by a distance $\alpha$ from a position where a corner E of the sheet 2 shown in FIG. 14 is presumably positioned (S204). In a case where the carriage 4 is moved to the position where the corner E of the sheet 2 is presumably positioned and the corner E of the sheet 2 is detected by the carriage sensor 44, if skewing or the like occurs on the sheet 2, the corner E of the sheet 2 may not be detected in some cases. Therefore, even though skewing occurs, a position where the sheet 2 is presumably positioned is set to be the predetermined position inward by the distance $\alpha$ from the position where the corner E is presumably positioned and the carriage sensor 44 is positioned such that a detection position of the carriage sensor 44 is set to this predetermined position. The CPU 101 moves the carriage 4 to a desired position based on detection results obtained from a linear encoder for detecting the position of the carriage 4 and stops the carriage 4. It should be noted that the corner E is selected as a more downstream apex of the sheet and in a case where the inclination of the sheet is in the reverse direction, a corner F is selected and a similar processing is performed.

The CPU 101 drives the feed roller 6 by the feed roller drive motor 106 to feed the sheet 2 to the inside of the printing apparatus 1 (S205). Further, the conveyance roller 7 is driven by the conveyance roller drive motor 105 to convey the fed sheet 2 downstream in the y direction by the conveyance roller pair (S205). Upon arrival of the sheet 2 at a detectable range of the carriage sensor 44, the leading end of the sheet 2 is detected by the carriage sensor 44 (S206), and then the detection result is sent to the CPU 101. The position information on a position P of the detected leading end is stored in a predetermined memory of the CPU 101. Upon detection of the leading end of the sheet 2 by the carriage sensor 44, the CPU 101 stops conveying the sheet 2 (S207).

Next, the CPU 101 moves the carriage 4 such that the detection position of the carriage sensor 44 is set inward by the distance $\alpha$ from the corner F on the opposite side of the corner E shown in FIG. 14 and then stops the carriage 4 (S208). At the same time, the CPU 101 conveys the sheet 2 so as to return the sheet 2 upstream in the y direction (S208) and sets the leading end of the sheet 2 at a position in the y direction upstream of the position of the carriage sensor 44. It should be noted that the processing is not limited to the aspect in which the movement of the carriage 4 and the return of the sheet 2 are simultaneously performed, but may be performed such that one of the operations is performed prior to the other.

After returning the sheet 2 upstream in the y direction until the leading end of the sheet 2 is positioned in the y direction upstream of the position of the carriage sensor 44, the CPU 101 again conveys the sheet 2 downstream in the y direction (S209). Similarly to the detection of the position P, upon detection of the leading end of the sheet 2 by the carriage sensor 44 (S210), position information on a position Q of the detected leading end is stored in a predetermined memory. Upon detection of the leading end of the sheet 2 by the carriage sensor 44, the CPU 101 stops conveying the sheet 2.

Subsequently, based on the position information on the positions P and Q, the CPU 101 virtually defines a line including the positions P and Q as a leading end border FL of the sheet 2 (S211). If there is skewing in the sheet conveyance, the leading end border FL line is inclined relative to the x direction and if there is no skewing, the line is a straight line parallel to the x direction. The CPU 101 calculates the inclination of the leading end border FL relative to the direction (the x direction) in which the carriage 4 moves, and obtains the positions (relative positions) of the two apexes, the corners E and F, of the leading end of the sheet from the width of the sheet to be used and the distance $\alpha$. Then, it is determined which of the two corners is a more downstream corner of the sheet. In the example of FIG. 14, the corner E is selected, but in a case where the sheet is inclined in a different direction, the corner F is selected. In a case where there is no inclination, any of the corners may be selected. Further, the CPU 101 obtains a mean value of the positions P and Q to calculate a position, in the y direction, of a center C (a reference position of a center reference) of the leading end border of the sheet 2 (S211). It should be noted that the processing is not limited to the mode in which the leading end of the sheet is detected at two positions, but the information for calculation may be obtained by performing detection at three positions.

By using these calculation results, the CPU 101 determines image data for driving the head for use in printing at the leading end portion of the sheet 2 (S212). Data obtained by excluding, from data corresponding to the region in the y direction downstream of the image data for the marginless printing generated according to the size of the sheet, data corresponding to a region where the sheet is not positioned, is determined to be data for use in printing at the leading end portion. In this case, considering detection errors by the carriage sensor 44, errors in the conveyance by the conveyance roller 7, and the like, data to be used is determined so as to prevent a border from remaining on the leading end portion of the sheet 2.

More specifically, as shown in FIG. 14, image data which is supposed to be printed with respect to the region in the y direction downstream of a line DL which is offset by a predetermined distance $\beta$ outward and parallel to the calculated leading end border FL is determined to be image data to be discarded 47. That is, data corresponding to the region in the y direction downstream of the position away from the leading end border FL by a predetermined amount is determined to be the image data to be discarded. The image data to be discarded 47 is discarded and data excluding the image data to be discarded 47 from the image data 46 is set to be image data for use in printing. It should be noted that in FIG. 14, the line DL is shown as a straight line, but is not necessarily a straight line. The line DL may be a stepwise line close to a straight line depending on a resolution and processing capability of the CPU 101.

In this manner, in performing the marginless printing at the leading end of the sheet, based on the information on the inclination of the sheet, an image region with respect to which ink is discarded to the outside of the sheet is set. If viewed from a different perspective, an image region with respect to which the ink is no longer discarded to the outside of the leading end of the sheet is set. Here, the information on the inclination of the sheet includes relative positions of the two corners E and F of the leading end of the sheet. Further, the more downstream corner (the corner E in the example of FIG. 14) of the sheet is important in setting the image region with respect to which the ink is discarded.

The CPU 101 conveys the sheet 2 such that the sheet 2 is located at a position (a printing start position) on the supporting surface 13 of the platen 9 (S213). A rotary encoder is mounted on the conveyance roller drive motor 105 and the CPU 101 confirms, based on the detection result of the rotary encoder, the amount of the sheet 2 to be conveyed to adjust the amount.

FIG. 13A shows the position (the printing start position) of the sheet 2 at printing operation start timing and FIG. 13B shows a position (a print completion position) of the sheet 2 at printing operation completion timing. In the state shown in FIG. 13A, the leading end border of the sheet 2 is positioned in the z direction above the groove 31 downstream in the y direction and in the y direction upstream of a most downstream ejection port 3*d*. An end positioned most downstream in the y direction is set to be a reference and this end is positioned in the z direction above the groove 31 downstream in the y direction and in the y direction upstream of the most downstream ejection port 3*d*. Upon start of the ejecting operation in this state, since all portions at the leading end border of the sheet 2 are positioned in the y direction upstream of the most downstream ejection port 3*d*, a border can be prevented from appearing on the leading end border of the sheet 2. In this state, a portion which was not applied to the sheet of the ink ejected from the ejection port is received at the absorbing member 35 disposed downstream in the y direction and on both sides in the x direction outside of the sheet 2.

After setting the sheet 2 at the printing start position, the printing operation is started (S214). The ink ejecting operation in which the ink is ejected from the printhead 3 along with the movement of the carriage 4 in the x direction is performed (S215). As described above, an image is printed on the sheet by the single pass printing in which image printing with respect to a predetermined region is completed by performing an ink ejecting operation along with one movement of the carriage 4. Further, each time the carriage 4 is positioned at the end portion in the x direction, that is, each time the carriage sensor 44 is set at a position where a side end of the sheet 2 can be detected, the position of the side end of the sheet 2 is detected by the carriage sensor 44 (S216). Based on the detection results of left and right side ends obtained in one movement of the carriage 4, image data for use in the ink ejecting operation along with the next movement of the carriage 4 is determined. Considering detection errors of the carriage sensor 44 and errors in the conveyance by the conveyance roller 7, the image data for use in printing is determined such that a border does not remain on the side end portion of the sheet 2. As shown in FIG. 14, image data up to lines (virtual lines) RL and LL which are offset by a predetermined distance $\gamma$ outside and parallel to the detected side ends is set to be the image data for use in printing. The conveying operation for conveying the sheet 2 downstream in the y direction is performed (S217).

Each time the operation of conveying the sheet 2 is completed, the CPU 101 confirms the detection result of the lever detection sensor 49 to determine whether the timing of starting the printing at the trailing end portion of the sheet 2 has arrived (S218). The CPU 101 detects the trailing end of the sheet 2 by using the lever detection sensor 49 to determine, based on the detection results of the lever detection sensor 49 and the rotary encoder, whether the timing of starting the printing at the trailing end portion of the sheet 2 has arrived.

Since the ink is already applied to a region in the y direction downstream of the sheet, in performing printing at the trailing end portion, if the end portion is detected while the conveyance direction of the sheet is being changed, similarly to the detection of skewing at the leading end, the image may be smeared with wet ink. A method may be considered in which after the detection of the trailing end of the sheet 2 by the carriage sensor 44, data corresponding to a region in the y direction upstream of the trailing end is deleted. However, in a case where there is skewing on the sheet 2, if the data corresponding to the region in the y direction upstream of an end portion after the detection of the end portion positioned most downstream in the y direction, is deleted, a border of the image may remain on the trailing end of the sheet 2 depending on the amount of skewing. On the other hand, even though the data corresponding to the region upstream of an end portion is attempted to be deleted after the detection of the end portion positioned most upstream in the y direction, there may be a case where the amount of image data which is not yet used for printing is small. Furthermore, there may be a case in which data processing may be missed without stopping temporarily the printing operation in data processing, in which case, temporarily stopping the printing operation requires time until the completion of the printing.

In view of these circumstances, detection of skewing is not performed with respect to the trailing end of the sheet. Instead, the center of the trailing end is detected by using the end detection lever 48 and the lever detection sensor 49, which are disposed at positions in the y direction upstream of the carriage sensor 44 and relatively far from the printhead 3.

The end detection lever 48 is disposed at a position through which any centers of sheets in various sizes presumably pass, and contacts a center portion of the sheet 2. That is, sheets in various widths are fed by a system called the center reference. The CPU 101 obtains the position of the center portion of the sheet 2 based on the detection results of the lever detection sensor 49 and the rotary encoder.

Moreover, with respect to the center portion of the sheet 2, immediately before the ejecting operation performed at a region of a distance ε inward of the trailing end of the sheet 2 shown in FIG. 15, the CPU 101 decreases the suction force to reduce the amount of air to be sucked. The center portion of the sheet 2 is positioned inward by a predetermined amount in the y conveyance direction downstream of the trailing end of the sheet 2 and then immediately before the ejecting operation at the region including the center portion of the sheet 2, the suction force is decreased. In such a manner, in performing printing sequentially from the leading end to the trailing end of the sheet, control is performed such that a portion to be printed approaches the trailing end of the sheet and then the suction force of the platen is decreased. As a result, the quantity of the ink mist flowing into the recess 17 from a slight gap between the reverse of the sheet 2 and the recess 17 can be reduced.

In this manner, in the configuration in which the sheet 2 is sucked to the platen 9, even though processing of deleting data is not performed with respect to the trailing end, unlike the processing performed with respect to the leading end, adhesion of the ink mist to the reverse of the sheet 2 can be reduced. Since the ink is already applied to the sheet 2 in printing at the trailing end, even though the suction force of the suction fan 19 is decreased, it is unlikely that the sheet 2 floats to contact the ejection port forming surface 3*a* shown in FIG. 13A and FIG. 13B. It should be noted that detection of skewing is not performed with respect to the trailing end, and thus it is preferable that the distance ε is set to be a value greater than the distance β or the distance γ. The distance ε is set to be, for example, from 1 mm to 10 mm.

Before the printing at the trailing end portion is started (NO in S218), the processing returns to S215. At the timing of starting printing at the trailing end portion (YES in S218), the CPU 101 controls the motor drive circuit 103 to decrease the driving rotational speed of the suction fan 19 from the previous speed (S219). This decreases the suction force of the suction fan 19. The "decreasing the suction force" includes stopping the rotational operation of the suction fan 19 to decrease the suction force to zero. The driving rotational speed of the suction fan 19 is determined according to the type of sheet 2, the type of ink to be applied to the sheet 2, environmental conditions inside the printing apparatus 1, and the like.

The CPU 101 determines whether the printing operation is completed or not (S220). The CPU 101 determines, based on whether image data to be printed still remains, whether the printing operation is completed or not. At the timing in which the most upstream end portion in the y direction of the trailing end of the sheet 2 reaches the print completion position shown in FIG. 13B, the printing operation for one sheet is completed. In the state shown in FIG. 13B, the most upstream trailing end in the y direction of the sheet 2 is positioned above the groove 31 upstream in the y direction and in the y direction downstream of a most upstream ejection port 3*c*. In this state, since any portion of the trailing end of the sheet 2 is positioned in the y direction downstream of the most upstream ejection port 3*c*, completing the ejecting operation in this state can prevent a border from appearing on the trailing end border of the sheet 2. In a case where the printing operation is not yet completed, that is, image data to be printed still remains (NO in S220), the processing returns to S215. In a case where the printing operation is completed, that is, image data to be printed does not remain (YES in S220), the sheet 2 is discharged to the discharge tray 12 from the inside of the printing apparatus 1 (S221) and the marginless printing processing is completed (S222).

As described above, in performing the marginless printing at the leading end of the sheet, the image region with respect to which the ink is discarded to the outside of the sheet is set based on the information on the inclination of the sheet. Two positions at the leading end of the sheet are detected to define the leading end border of the sheet and data corresponding to the region outside the leading end border is discarded. That is, the image region with respect to which the ink is discarded to the outside of the sheet is set such that the ink is discarded up to the downstream parallel to and away, by the predetermined distance β, from a side of the leading end of the sheet and the ink is not discarded further downstream. Focusing on the further downstream corner of the sheet which is important, in applying the ink to the corner E of the sheet, the ink is discarded up to the downstream away from the corner E of the sheet by the predetermined distance β and the ink is not discarded further downstream.

In performing the marginless printing, even though skewing occurs on the sheet, the ink to be discarded to the outside of the sheet particularly at the leading end side of the sheet is suppressed to reduce the unnecessary consumption of ink. Further, as compared to a case in which data is not discarded, the quantity of the ink mist generated is reduced due to the reduction in the quantity of the ink to be ejected and adhesion of the ink mist to components of the printing apparatus or the reverse of the sheet is reduced.

Meanwhile, with respect to the trailing end portion of the sheet 2, the suction force of the suction fan 19 is decreased starting from a predetermined position to reduce the quantity of air taken into the suction holes 18, thereby reducing the quantity of the ink mist as well as the air taken into the suction holes 18 to enable the reduction in the quantity of the ink mist adhering to the reverse of the trailing end of the sheet 2. In this manner, also in the configuration in which the suction fan 19 is used, the quantity of the ink mist adhering to the reverse of the sheet 2 can be reduced. With respect to the trailing end portion of the sheet 2, by stopping the operation of the suction fan 19 in decreasing the suction force, the effect of reducing the quantity of the ink mist adhering to the reverse of the sheet 2 can be improved.

Figure 16:
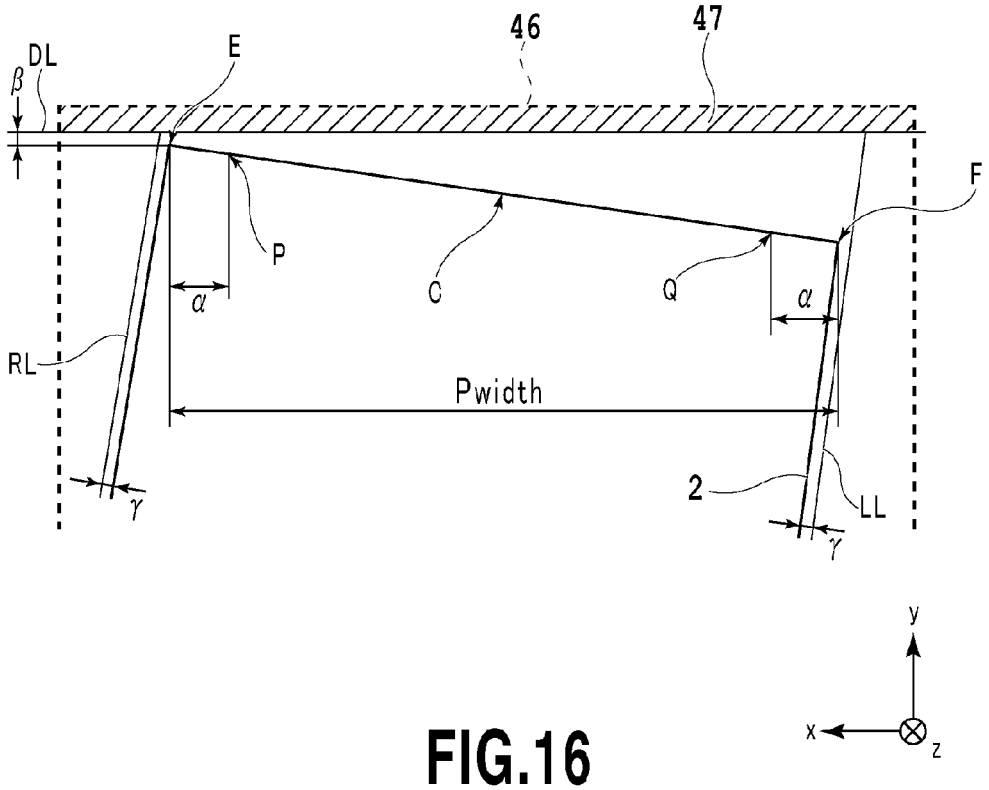
FIG. 16 is a schematic view for explaining processing with respect to a leading end of a sheet by way of another example.

FIG. 16 is a schematic view for explaining another example of processing with respect to the leading end of the sheet 2. The left and right side ends and the trailing end are processed in the same manner as in the above processing.

Specifically, in S211 of FIG. 12, based on the detection results of the positions P and Q, the position of the corner E most downstream in the y direction is calculated. In S212, with respect to the image data 46, a virtual line DL is set, which passes a region which is away, by a predetermined distance β outside in the downstream, from the position of the corner E, which is a downstream apex of the sheet, and parallel to the scanning direction (the x direction) of the carriage 4. Then, data corresponding to the region in the y direction downstream of the virtual line DL is set to be the image data to be discarded 47. The corner E is selected as the apex in the downstream of the inclination, and if the inclination of the sheet is in the reverse direction, the corner F is selected and a similar processing is performed. In this manner, data obtained by excluding, from the image data 46, the image data to be discarded 47 is set to be the image data for use in printing at the leading end portion of the sheet 2. That is, in applying the ink to the further downstream corner E of the sheet in the marginless printing, the image region with respect to which the ink is discarded to the outside of the sheet is set such that the ink is discarded up to the downstream away from the corner E of the sheet by the predetermined distance β and the ink is not discarded further downstream.

In the case shown in FIG. 16, as compared to the case explained with reference to FIG. 14, processing time in S212 of FIG. 12 can be reduced. Also in the case shown in FIG. 16, if skewing occurs on the sheet 2, data corresponding to the region outside the most downstream position in the y direction of the leading end of the sheet 2 is discarded, and thus the ink consumption for the corresponding region of the data can be suppressed. That is, in performing the marginless printing, even though skewing occurs on the sheet, the quantity of the ink to be discarded to the outside of the sheet at particularly the leading end side of the sheet is suppressed to reduce unnecessary ink consumption. The quantity of the ink mist adhering to each member of the printing apparatus 1 and the reverse of the sheet 2 can also be reduced.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Applications No. 2015-108004, filed May 27, 2015, No. 2015-108006, filed May 27, 2015 which are hereby incorporated by reference wherein in their entirety.

What is claimed is:

1. A printing method comprising:

a conveying step of conveying a sheet;

a first generation step of generating first image data having a size larger than a size of the sheet when an instruction of marginless printing is received;

an obtaining step of obtaining inclination information on the sheet;

a second generation step of generating second image data which is generated by discarding image data corresponding to a region in which ink is not ejected from the first image data based on the inclination information obtained in the obtaining step; and a printing step of causing a printhead to eject ink and perform printing based on the second image data.

2. The printing method according to claim 1, wherein the data to be discarded from the first image data is determined by relative positions of two corners of the sheet that define a leading end border.

3. The printing method according to claim 2, wherein in applying ink to one of the two sheet corners in the marginless printing, ink is ejected up to a downstream side away from the one sheet corner by a predetermined distance, and ink is not ejected further downstream.

4. The printing method according to claim 3, wherein ink is ejected up to the downstream side parallel to the leading end border of the sheet and away therefrom by the predetermined distance and ink is not ejected further downstream.

5. The printing method according to claim 1, wherein a leading end of the sheet is detected by a sensor at a plurality of positions in a sheet widthwise direction to obtain the inclination information.

6. The printing method according to claim 5, wherein the sensor is mounted on a carriage which makes a reciprocating motion, the carriage having the printhead mounted thereon, and wherein in a state in which the carriage is stopped, an operation of detecting the leading end of the sheet by the sensor while the sheet is being moved is repeated at the plurality of positions.

7. The printing method according to claim 5, wherein the plurality of positions are two positions inward, by a predetermined amount, of both ends of the sheet in the sheet widthwise direction.

8. The printing method according to claim 1, wherein the printhead is mounted on a carriage which makes a reciprocating motion to perform serial printing.

9. A printing apparatus comprising:

a printhead which ejects ink;

a conveying unit configured to convey a sheet;

a platen configured to support the sheet by suction, wherein the platen comprises a plurality of supporting portions each including a suction hole, and a groove provided adjacent to the supporting portions to receive ink discarded outside of the sheet;

an obtaining unit configured to obtain information on an inclination of the sheet to be conveyed by the conveying unit; and a control unit configured to set, in performing marginless printing at a leading end of the sheet, an ink discard region at which ink is discarded to an outside of the sheet from the printhead, based on the information obtained by the obtaining unit.

10. The printing apparatus according to claim 9, wherein in performing printing sequentially from the leading end to a trailing end of the sheet, a suction force of the platen is decreased upon approach of a portion to be printed at the trailing end of the sheet.

11. The printing apparatus according to claim 9, further comprising a carriage which mounts the printhead and a sensor for detecting a sheet end and makes a reciprocating motion to perform serial printing.

12. A printing apparatus comprising:

a conveying unit configured to convey a sheet;

a printhead configured to eject ink to the sheet and perform printing, the printhead being able to perform marginless printing on the sheet;

a first generation unit configured to generate first image data having a size larger than a size of the sheet when an instruction of marginless printing is received;

an obtaining unit configured to obtain inclination information on the sheet conveyed by the conveying unit;

a second generation unit configured to generate second image data which is generated by discarding image data corresponding to a region in which ink is not ejected from the first image data based on the inclination information obtained by the obtaining unit; and a control unit configured to cause a printhead to perform a print operation based on the second image data.

13. The printing apparatus according to claim 12, wherein the obtaining unit obtains the inclination information on a leading end of the sheet.

14. The printing apparatus according to claim 13, wherein the data to be discarded from the first image data is determined by relative positions of two corners of the sheet that define a leading end border.

15. The printing apparatus according to claim 14, wherein in applying ink to one of the two sheet corners in the marginless printing, ink is ejected up to a downstream side away from the one sheet corner by a predetermined distance, and ink is not ejected further downstream.

16. The printing apparatus according to claim 15, wherein ink is ejected up to the downstream side parallel to the leading end border of the sheet and away therefrom by the predetermined distance and ink is not ejected further downstream.

17. The printing apparatus according to claim 12, wherein a leading end of the sheet is detected by a sensor at a plurality of positions in a sheet widthwise direction to obtain the inclination information.

18. The printing apparatus according to claim 17, wherein the sensor is mounted on a carriage which makes a reciprocating motion, the carriage having the printhead mounted thereon, and wherein in a state in which the carriage is stopped, an operation of detecting the leading end of the sheet by the sensor while the sheet is being moved is repeated at the plurality of positions.

19. The printing apparatus according to claim 17, wherein the plurality of positions are two positions inward, by a predetermined amount, of both ends of the sheet in the sheet widthwise direction.

20. The printing apparatus according to claim 12, wherein the printhead is mounted on a carriage which makes a reciprocating motion to perform serial printing.

* * * * *